US005797561A

United States Patent [19]

Madrzak

[11] Patent Number: 5,797,561

[45] **Date of Patent: *Aug. 25, 1998**

[54] UNWINDING STATION FOR FIBER WEBS INCLUDING A DEVICE FOR PERFORMING A FLYING SPLICE

[75] Inventor: Zygmunt Madrzak, Heidenheim, Germany

[73] Assignee: Voith Sulzer Papiermaschinen GmbH, Heidenheim, Germany

[ * ] Notice: The term of this patent shall not extend beyond the expiration date of Pat. No. 5,647,556.

[21] Appl. No.: 892,212

[22] Filed: Jul. 14, 1997

Related U.S. Application Data

[63] Continuation of Ser. No. 498,094, Jul. 5, 1995, Pat. No. 5,647,556.

[51] Int. Cl.[6] ..... B65H 21/00

[52] U.S. Cl. ..... 242/554.6; 242/555.4; 242/555.3

[58] Field of Search ..... 242/554.5, 554.6, 242/555.3, 555.4

[56] References Cited

U.S. PATENT DOCUMENTS 3,918,655 11/1975 Hillner et al. ..... 242/554.5 X 4,077,580 3/1978 Lang et al. ..... 242/554.6 X 4,934,621 6/1990 Jacobs ..... 242/554.6

OTHER PUBLICATIONS

Voith Publication No. P2827.

*Primary Examiner*—John Q. Nguyen

*Attorney, Agent, or Firm*—Taylor & Associates, P.C.

[57] ABSTRACT

An unwinding station for fiber webs, particularly paper webs, features a support each for a new web roll (primary paper roll 16) and for a previous web roll (secondary paper roll) as well as a system for splicing the web leader of the primary paper roll on the fly to the web end of the secondary paper roll. This system allows the so-called flying splice. A drive unit (M) operating selectively as a motor or brake is coupled to the primary paper roll (16). An RPM control (24) or a web draw control (25) is coupled selectively to a control (20) of the drive unit (M) using a switching system (34). An additional drive (M') operating exclusively as a motor is coupled to the primary paper roll (16), and at that, during the period of time between the activation of the drive unit (M) and splicing the web on the fly, independent of the drive unit (M).

5 Claims, 2 Drawing Sheets

UNWINDING STATION FOR FIBER WEBS INCLUDING A DEVICE FOR PERFORMING A FLYING SPLICE

This is a continuation of application Ser. No. 08/498,094, filed Jul. 5, 1995, U.S. Pat. No. 5,647,556.

BACKGROUND OF THE INVENTION

1. Field of the invention

The present invention relates to a method of performing flying splices in an unwinding station, and, more particularly, relates to a method of splicing the leader of a new roll of a web roll ("primary roll") on the fly to the end of a preceding (nearly spent) web roll ("secondary roll") from which a web is being unwound for treatment.

2. Description of the related art.

A method of performing a flying splice may be used at an unwinding station of a paper coater or on other, similar machines serving the treatment or processing of paper webs. The splicing of the two webs to one another must take place at full operating speed and, therefore, requires a very precise control. The operating speed may amount to 1500 m/min and can assume even higher values. This splicing operation is mostly called a "flying splice" in the paper industry. An example of equipment for making a flying splice is disclosed in Voith publication p2827.

It is known that in preparation of a flying splice the primary roll is rotated by means of a drive unit, adapting its peripheral speed as exactly as possible to the momentary operating speed of the machine, and thus to the momentary velocity at which the web unwound so far departs from the secondary roll. A prerequisite is, among others, that the unwinding station feature a braking system which makes it possible to always maintain a certain longitudinal tension (web draw) on the unwinding web. A drive unit which is operated selective as a motor or as a brake is usually provided, at least for the primary roll. But it is understood that the drive unit of the primary roll cannot generate the desired draw on the web unwinding from the primary roll until the flying splice of the web leader of the primary roll to the web end of the secondary roll has taken place.

The drive unit is preferably an electric machine or, as the case may be, a hydraulic machine that can be switched to braking operation.

A difficulty is constituted by the fact that in the prior methods the desired draw in the web unwinding from the primary roll does not build up with sufficient swiftness. Observed is mostly a temporary collapse of the draw immediately after the flying splice.

SUMMARY OF THE INVENTION

The present invention aims to improve the initially described method with the effect that the temporary collapse of the web draw just described will be avoided.

According to one aspect of the invention, when the drive unit of the primary roll accelerates the roll, or after the primary roll has assumed a peripheral speed corresponding as closely as possible to the machine speed, an additional drive is engaged with the primary roll, independently of the drive unit. As a result, the peripheral speed of the primary roll tends to assume an excessive value. Therefore, the RPM control coordinated with the drive unit switches the drive unit always to a braking operation (e.g., a regenerative operation) before the flying splice, so that the drive unit will adapt the peripheral speed of the primary roll—as required—as exactly as possible to the speed of the paper machine.

According to the invention, the switching of the drive unit of the primary roll from motor to braking operation thus takes place sooner than with the prior art, namely not only simultaneously with or shortly after the flying splice, but already a certain time ahead of it. As the drive unit is now, simultaneously with the flying splice, decoupled from the RPM control that has been effective so far and is coupled, instead, to a web draw control, the drive unit—being already in braking operation—is immediately ready to adjust the desired web draw. The previously disturbing temporary collapse of the web draw is thus avoided completely, or at least very extensively.

A device serving the application of the method is comprised essentially of an unwinding station for webs, notably paper webs, featuring a support each for a new web roll (primary roll) and for a previous web roll (secondary roll) and a system for splicing the leader of the primary roll on the fly to the web end of the secondary roll. Hence, the system allows the so-called flying splice. Further features are:

a) a drive unit operating selectively as a motor or as a brake which can be coupled to the primary roll; and b) an RPM control or web draw control which can selectively be coupled, by means of a switching system, to a control of the drive unit.

According to the invention, an additional drive (operating preferably exclusively as a motor) can be coupled to the primary roll independently of the drive unit.

The additional drive includes a switching system with the aid of which the additional drive unit can be cut in during or after acceleration of the primary roll by the drive unit and cut out again at least approximately at the moment of the splicing operation.

In a preferred embodiment of the invention, the additional drive can be controlled by means of an output control system. Adjustment of a specific output makes it possible to achieve indirectly that the braking output of the retarding drive unit is already before the splicing operation set to a specific braking output which at least approximately corresponds to the web draw desired (after the splice).

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
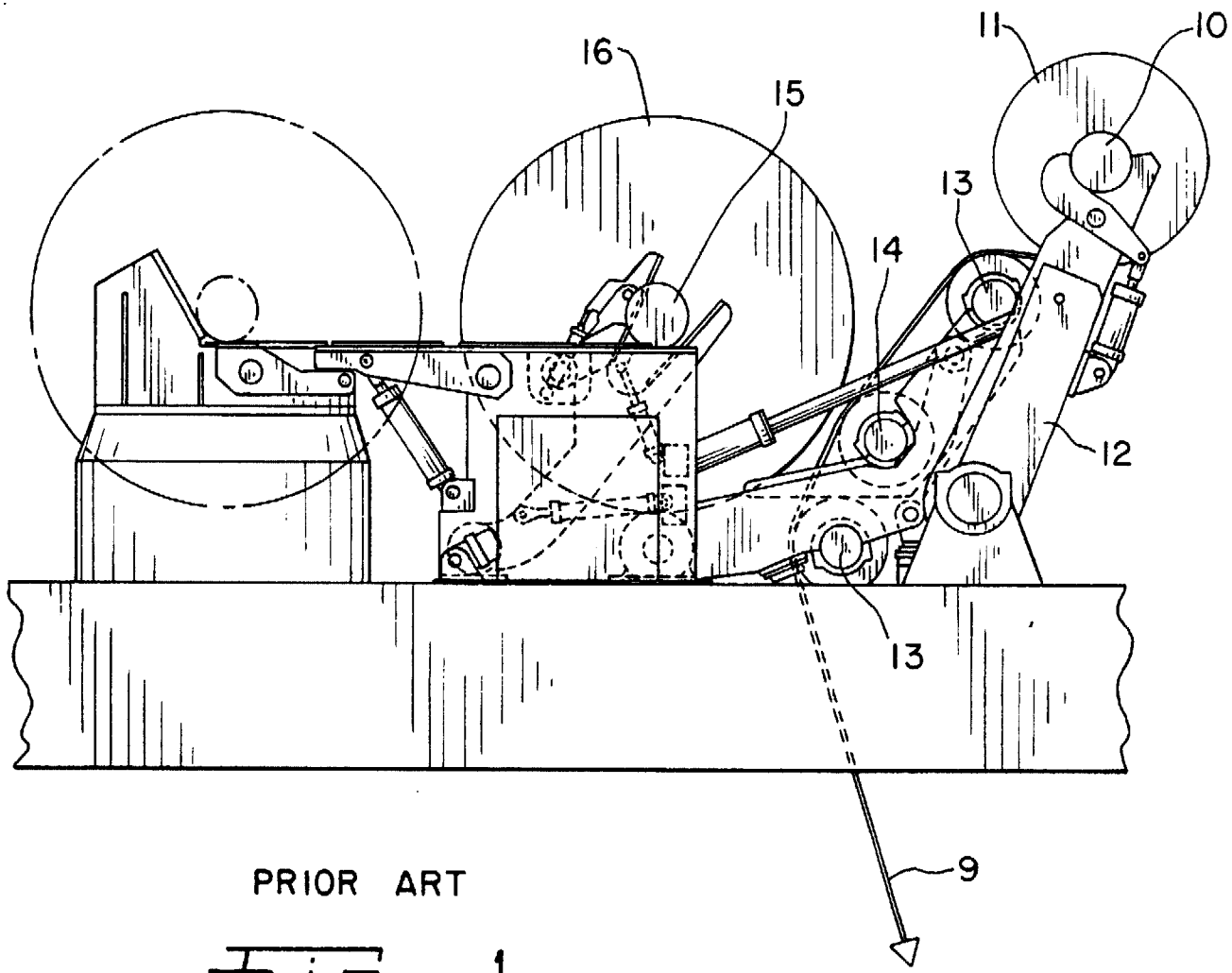
PRIOR ART Fig. 1
FIG. 1 is a conventional unwinding station in side elevation.

Visible in FIG. 1 is a secondary winding drum 10 with a secondary roll 11 which is supported by the unwinding pivot 12 and from which unwinds a paper web 9 toward a not illustrated processing machine, for instance a coater. The unwinding paper web 9 proceeds over guide rolls 13 and a splicing roll 14. A primary winding drum 15 with a still full primary roll 16 is available.

Before the web end of the secondary roll 11 unwinds from the secondary winding drum 10, the primary roll 16 is rotated to a peripheral speed which as closely as possible corresponds to the unwinding velocity of the web 9 from the secondary roll. Next, the web leader of the primary roll and the web end of the secondary roll are spliced on the fly, that is, at the full machine speed, in known fashion by means of the splicing roll 14, along with severing the web remainder of the secondary roll. Upon removal of the secondary winding drum from the swivel arms 12, the latter receives the primary winding drum 15 with the primary paper roll 16.

Figure 2:
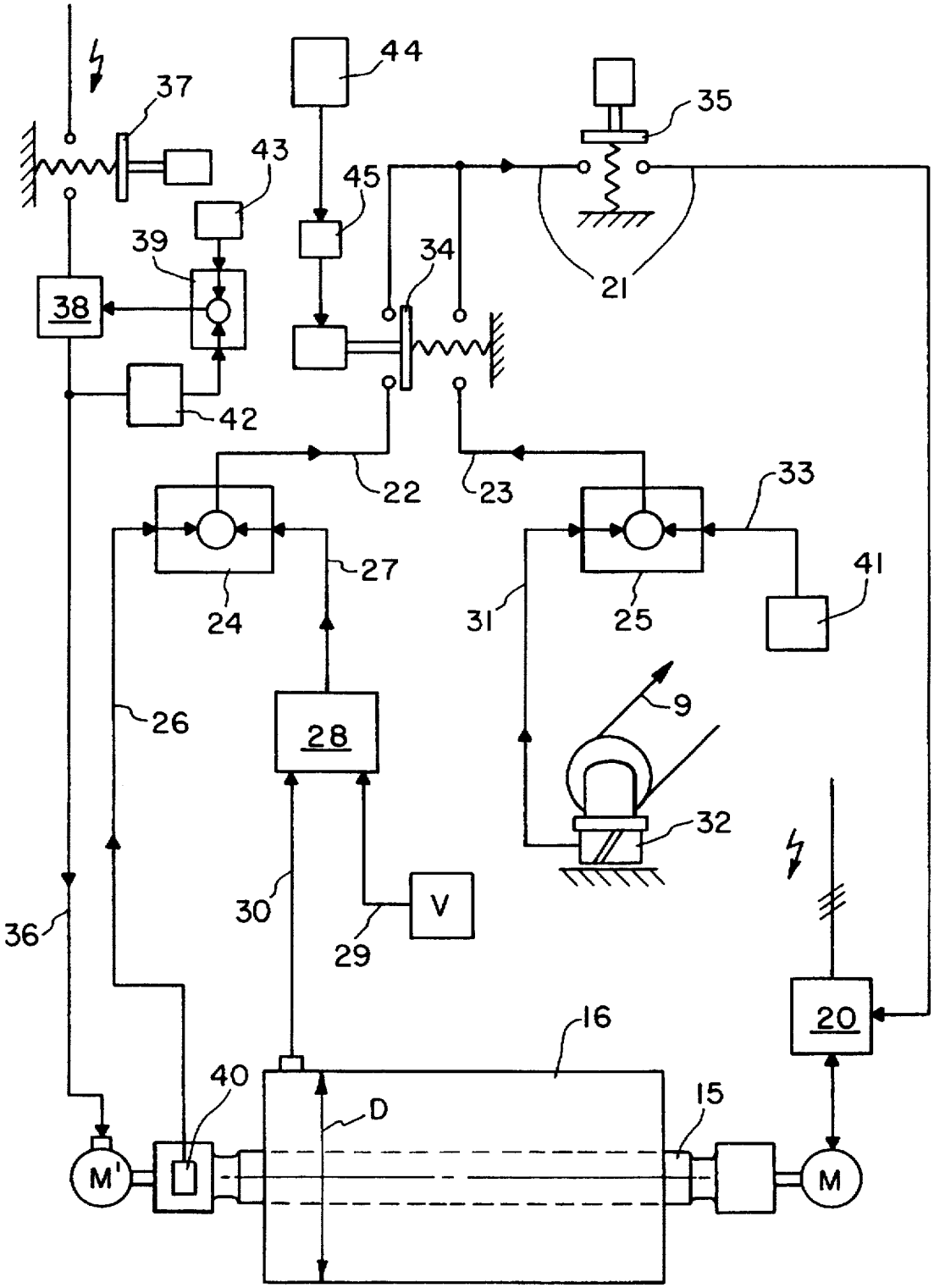
FIG. 2 is a schematical illustration of several elements of a control system for the unwinding station according to FIG. 1, along with accessory systems for performing the inventional method.

Visible in FIG. 2 is the primary winding drum 15 with the primary paper roll 16 and with a drive unit M coupled to it. Drive unit M is connected to a control 20 which controls the speed of rotation of the drive unit M and is able to switch drive unit M from motor operation to regenerative operation (i.e., braking operation), or vice versa. Control 20 receives a control signal, via a line system 21, 22, 23, either from an RPM control 24 or from a web draw control 25. The actual value of the RPM of primary winding drum 15 is fed to the RPM control 24 via a line 26 from a measuring system 40, additionally an RPM setpoint via the line 27. The set point is formed in a setpoint former 28 from the variables machine speed v and diameter D of the primary paper roll 16 (lines 29 and 30). The web draw control 25 receives an actual draw value via line 31 from a web draw measuring system 32, and an adjustable web draw setpoint via a line 33 (from a setpoint encoder 41). A switching system 34 allows connecting either output 22 of controller 24 or output 23 of controller 25 to the control line 21; the switching system 34 connects in its illustrated inactive home position the lines 21 and 22 to each other. Included in line 21 is a switch 35 that is open in its home position.

According to an aspect of the present invention, an additional drive M' is coupled to the primary winding drum 15 and can be activated via a line 36 with switch 37, and the output of which additional drive M' can be controlled by means of control unit 38 and output control 39. Fed to the latter is an actual value from an output measuring device 42 and a setpoint from a setpoint encoder 43.

The following control operations take place successively in a flying splice:

1. Switch 35 is closed, causing the drive unit M to rotate the primary paper roll 16, controlled by RPM control 24.
2. Switch 37 is closed to activate also the additional drive M'. As a result, the actual RPM value of the primary roll 16 tends to surmount the setpoint. In response, RPM control 24, via the control system 20, switches the drive unit M from motor operation to regenerative or braking operation. The output level of the additional drive M' set by output control 39 determines the level of braking output of the drive unit M.
3. About simultaneously with the splicing operation (for instance immediately thereafter), switch 37 opens again, thus cutting the additional drive M' out. Besides—immediately before or after splicing or simultaneously with it—the switching system 34 is actuated, so that the drive unit M is now controlled by the web draw control 25, thus generating immediately the desired web draw. In other words, the web draw generated previously by a braking system of the secondary paper roll 11 is after the splicing operation maintained immediately by the drive unit M. A previously observed collapse of the web draw during the splicing operation is avoided thereby.

The actuation of switching system 34 is triggered by a signal fed to it from a control 44 (preferably via a timer 45), which serves to initiate the splicing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An unwinding station for fiber webs, including a primary roll and a secondary roll, and a system for splicing on the fly a web leader of the primary roll to a web end of the secondary roll, said unwinding station comprising:

a drive unit coupled to the primary roll for rotating the primary roll, said drive unit selectively operable as one of a motor and brake to respectively increase and decrease an RPM of the primary roll, said drive unit operable as a motor to substantially match a peripheral speed of the primary roll with an unwinding speed of the secondary roll;

a drive unit control for controlling said selective operation of said drive unit;

an RPM control operatively associated with and selectively interconnected to said drive unit control for providing a control signal representing the RPM of the primary roll to the drive unit control;

a web draw control operatively associated with and selectively interconnected to said drive unit control for providing a control signal representing a web draw to the drive unit control;

a switching system for selectively interconnecting one of said RPM control and said web draw control with said drive unit control; and an additional drive unit coupled to the primary roll independent from said drive unit, a means for activating said additional drive unit to increase the RPM of the primary roll above the unwinding speed of the secondary roll prior to splicing;

wherein said selective operation of said drive unit as a brake is dependent upon said increased RPM of the primary roll caused by said additional drive unit.

2. The unwinding station of claim 1, wherein said switching system interconnects said drive unit control with said RPM control prior to interconnecting said drive unit control with said web draw control.

3. The unwinding station of claim 1, further comprising an output control system connected to and controlling said additional drive.

4. The unwinding station of claim 1 further comprising a switch for activating said additional drive during or after acceleration of the primary roll by said drive unit, and for deactivating said additional drive during the splicing on the fly.

5. An unwinding station for fiber webs, including a primary roll and a secondary roll, and a system for splicing on the fly a web leader of the primary roll to a web end of the secondary roll, said unwinding station comprising:

a drive unit coupled to the primary roll for rotating the primary roll, said drive unit selectively operable as one of a motor and brake to respectively increase and decrease an RPM of the primary roll, said drive unit operable as a motor to substantially match a peripheral speed of the primary roll with an unwinding speed of the secondary roll;

a drive unit control for controlling said selective operation of said drive unit;

an RPM control operatively associated with and selectively interconnected to said drive unit control for providing a control signal representing the RPM of the primary roll to the drive unit control;

a switching system for selectively interconnecting said RPM control with said drive unit control; and an additional drive unit coupled to the primary roll independent from said drive unit, a means for activating said additional drive unit to increase the RPM of the primary roll above the unwinding speed of the secondary roll prior to splicing;

wherein said selective operation of said drive unit as a brake is dependent upon said increased RPM of the primary roll caused by said additional drive unit.

* * * * *